US011243482B2

(12) United States Patent
Tsujihiro et al.

(10) Patent No.: US 11,243,482 B2
(45) Date of Patent: Feb. 8, 2022

(54) TONER

(71) Applicant: KYOCERA Document Solutions Inc., Osaka (JP)

(72) Inventors: Masami Tsujihiro, Osaka (JP); Ken Maetani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/906,928

(22) Filed: Jun. 19, 2020

(65) Prior Publication Data

US 2020/0401059 A1 Dec. 24, 2020

(30) Foreign Application Priority Data

Jun. 21, 2019 (JP) ..... JP2019-115489

(51) Int. Cl.
*G03G 9/087* (2006.01)
*G03G 9/083* (2006.01)

(52) U.S. Cl.
CPC ..... *G03G 9/08788* (2013.01); *G03G 9/0837* (2013.01); *G03G 9/08728* (2013.01); *G03G 9/08755* (2013.01)

(58) Field of Classification Search
CPC ..... G03G 9/08711; G03G 9/08755; G03G 9/08788
See application file for complete search history.

(56) References Cited

U.S. PATENT DOCUMENTS

| | | | | |
|---|---|---|---|---|
| 6,811,944 | B2 | 11/2004 | Higuchi et al. | |
| 6,813,461 | B2 | 11/2004 | Higuchi et al. | |
| 6,911,289 | B2 | 6/2005 | Higuchi et al. | |
| 2002/0081513 | A1 | 6/2002 | Higuchi et al. | |
| 2004/0166428 | A1 | 8/2004 | Higuchi et al. | |
| 2004/0166429 | A1 | 8/2004 | Higuchi et al. | |
| 2006/0008723 | A1* | 1/2006 | Fujikawa | G03G 9/09708 430/108.6 |
| 2006/0141379 | A1* | 6/2006 | Teramoto | G03G 5/08221 430/106.2 |
| 2011/0305984 | A1* | 12/2011 | Tominaga | G03G 9/09314 430/108.4 |
| 2017/0038697 | A1* | 2/2017 | Onishi | G03G 9/08791 |
| 2018/0149989 | A1* | 5/2018 | Suzuki | C08F 287/00 |

FOREIGN PATENT DOCUMENTS

| | | |
|---|---|---|
| JP | 2002-304006 A | 10/2002 |
| JP | 2010-128466 A | 6/2010 |

* cited by examiner

*Primary Examiner* — Peter L Vajda
(74) *Attorney, Agent, or Firm* — Studebaker & Brackett PC

(57) ABSTRACT

A toner includes toner particles. The toner particles each include a toner mother particle. The toner mother particles contain a binder resin and a magnetic powder. The binder resin includes a polyester resin, a vinyl resin, and a block polymer. The block polymer includes a polyester portion, a vinyl polymer portion, and a linker that links the polyester portion and the vinyl polymer portion. The linker is derived from a specific compound having a vinyl group and at least one of a carboxy group and an alcoholic hydroxyl group. The magnetic powder has an octahedral structure.

4 Claims, 1 Drawing Sheet

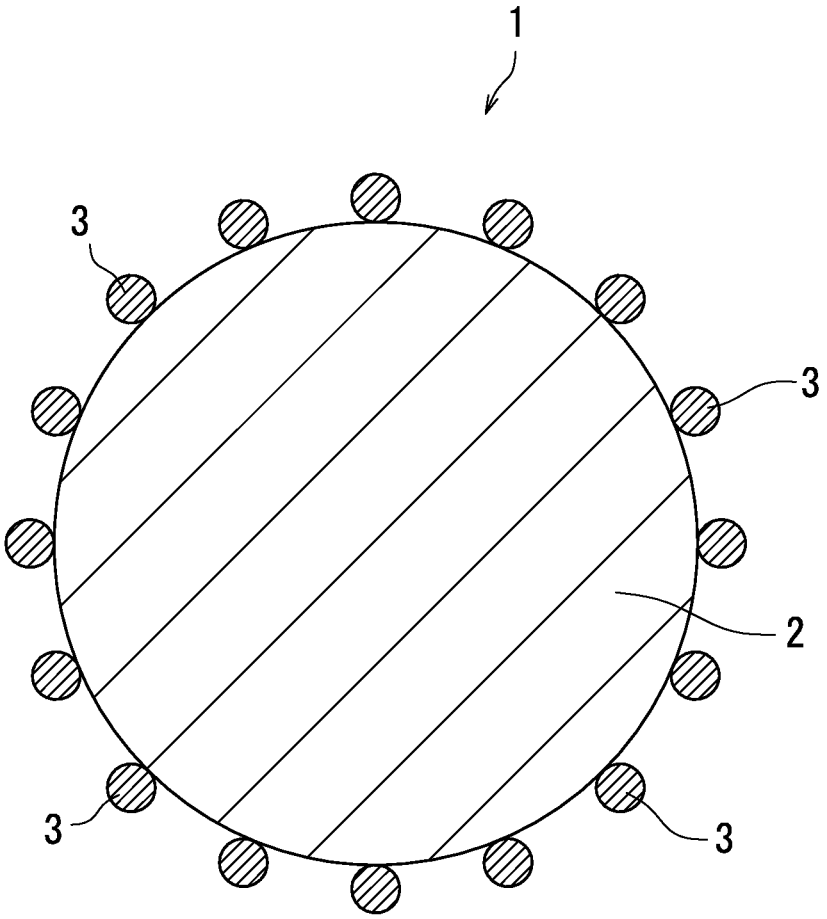
1
3
3
2
3
3

TONER

INCORPORATION BY REFERENCE

The present application claims priority under 35 U.S.C. § 119 to Japanese Patent Application No. 2019-115489, filed on Jun. 21, 2019. The contents of this application are incorporated herein by reference in their entirety.

BACKGROUND

The present disclosure relates to a toner.

A toner (particularly, a toner for development of electrostatic latent images) includes toner particles each including a toner mother particle. The toner mother particles contain a binder resin. As the binder resin, for example a polyester resin is used. It is also proposed that a block polymer including a polyester portion, a vinyl polymer portion, and a linker that links the polyester portion and the vinyl polymer portion be used as the binder resin.

SUMMARY

A toner according to an aspect of the present disclosure includes toner particles. The toner particles each include a toner mother particle. The toner mother particles contain a binder resin and a magnetic powder. The binder resin includes a polyester resin, a vinyl resin, and a block polymer. The block polymer includes a polyester portion, a vinyl polymer portion, and a linker that links the polyester portion and the vinyl polymer portion. The linker is derived from a specific compound having a vinyl group and at least one of a carboxy group and an alcoholic hydroxyl group. The magnetic powder has an octahedral particle structure.

BRIEF DESCRIPTION OF THE DRAWING

FIGURE is a schematic cross-sectional view of an example of a toner particle included in a toner according to the present disclosure.

DETAILED DESCRIPTION

The following describes a preferred embodiment of the present disclosure. Note that a toner refers to a collection (for example, a powder) of toner particles. An external additive refers to a collection (for example, a powder) of external additive particles. Evaluation results (for example values indicating a shape and values indicating properties) for a powder (specific examples include a powder of toner particles and a powder of external additive particles) are each a number average of values measured with respect to a suitable number of particles selected from the powder, unless otherwise stated.

Values for volume median diameter ($D_{50}$) of a powder are values measured based on the Coulter principle (electrical sensing zone technique) using "Coulter Counter Multisizer 3" produced by Beckman Coulter, Inc. unless otherwise stated.

Unless otherwise stated, a number average primary particle diameter of a powder is a number average value of equivalent circle diameters of primary particles of the powder (Heywood diameters: diameters of circles having the same areas as projected areas of the respective primary particles) measured using a scanning electron microscope. The number average primary particle diameter of a powder is a number average value of equivalent circle diameters of for example 100 primary particles. Note that a number average primary particle diameter of particles is a number average primary particle diameter of the particles of a powder unless otherwise stated.

Chargeability refers to chargeability in triboelectric charging unless otherwise stated. Positive chargeability (or negative chargeability) in triboelectric charging can be confirmed using a known triboelectric series for example.

Unless otherwise stated, a "main component" of a material refers to a component contained the most in the material in terms of mass.

A level of hydrophobicity (or a level of hydrophilicity) can be expressed for example in terms of a contact angle of a water drop (wettability to water). The larger the contact angel of a water drop is, the higher the level of hydrophobicity is.

A measurement value of a melting point (Mp) is a temperature of a largest heat absorption peak on a heat absorption curve (vertical axis: heat flow (DSC signal), horizontal axis: temperature) plotted using a differential scanning calorimeter ("DSC-6220", product of Seiko Instruments Inc.). The heat absorption peak appears due to fusion of a crystallized portion.

A glass transition point (Tg) is a value measured in accordance with "Japanese Industrial Standards (JIS) K7121-2012" using a differential scanning calorimeter ("DSC-6220", product of Seiko Instruments Inc.) unless otherwise stated. On a heat absorption curve (vertical axis: heat flow (DSC signal), horizontal axis: temperature) plotted using the differential scanning calorimeter, the glass transition point (Tg) corresponds to a temperature of inflection point resulting from glass transition (specifically, a temperature at an intersection point of an extrapolation of a base line and an extrapolation of an inclined portion of the curve).

Each measurement value of number average molecular weight (Mn) and mass average molecular weight (Mw) is a value measured using a gel permeation chromatography unless otherwise stated.

Acid values and hydroxyl values are values measured in accordance with "Japanese Industrial Standard (JIS) K0070-1992" unless otherwise stated.

The term block polymer refers to a polymer constituted by a plurality of blocks that are linearly linked together.

In the following description, the term "-based" may be appended to the name of a chemical compound to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl. Also, the term "(meth)acrylonitrile" is used as a generic term for both acrylonitrile and methacrylonitrile.

<Toner>

A toner according to an embodiment of the present disclosure includes toner particles. The toner particles each include a toner mother particle. The toner mother particles contain a binder resin and a magnetic powder. The binder resin includes a polyester resin, a vinyl resin, and a block polymer. The block polymer includes a polyester portion, a vinyl polymer portion, and a linker that links the polyester portion and the vinyl polymer portion. The linker is derived from a specific compound (also referred to below as a bireactive monomer) having a vinyl group and at least one of a carboxy group and an alcoholic hydroxyl group. The magnetic powder has an octahedral particle structure.

The toner according to the present disclosure is favorably used as for example a positively chargeable magnetic toner (one-component developer) for development of electrostatic latent images.

As a result of having the above constitution, the toner according to the present disclosure is excellent in low-temperature fixability and hot offset resistance. The following describes a reason therefor. As a result of the toner mother particles in the toner according to the present disclosure containing a polyester resin as a binder resin, the toner is excellent in low-temperature fixability. The toner mother particles include a magnetic powder and a block polymer having a polyester portion and a vinyl polymer portion. The block polymer adsorbs the magnetic powder via the vinyl polymer portion. This is because the vinyl polymer portion has low affinity for the polyester resin and the polyester portion and relatively high affinity for the magnetic powder. Further, a polyester portion in a block polymer interacts with a polyester portion in another block polymer in each toner mother particle. Thus, the magnetic powder and the block polymers form a three-dimensional mesh structure in each toner mother particle. Particles of the magnetic powder function as cross-linking points in the three-dimensional mesh structure. As a result of having an octahedral structure, the magnetic powder in the toner mother particles has a larger specific surface area than a spherical magnetic powder having the same particle diameter as that of the magnetic powder, and has flat surfaces. Therefore, as a result of the magnetic powder having an octahedral structure, the block polymer tends to adsorb the magnetic powder via the vinyl polymer portion, resulting in easy formation of the tree-dimensional mesh structure as described above. The three-dimensional mesh structure appropriately inhibits the toner particles from melting at high temperature to impart improved hot offset resistance to the toner of the present disclosure without significantly reducing low-temperature fixability thereof. As a result, the toner according to the present disclosure is excellent in low-temperature fixability and hot offset resistance.

Note that combinational use of a polyester resin and a vinyl resin each as a binder resin is not preferable in a known toner. A known toner that uses a polyester resin and a vinyl resin in combination as a binder resin tends to involve occurrence of smear. The smear herein refers to a phenomenon of a toner component fixed to a surface of a specific printed sheet peeling off the surface and attaching to a surface of another printed sheet due to the printed sheets rubbing against each other in staking the printed sheets. The following describes a cause of occurrence of a smear through use of a known toner using a polyester resin and a vinyl resin in combination as a binder resin. Affinity between a polyester resin and a vinyl resin is low. Therefore, in the known toner using the polyester resin and the vinyl resin in combination as a binder resin, phase separation tends to occur between the polyester resin and the vinyl resin to form an interface when the toner is fixed to a surface of a sheet to be printed. When a printed sheet with an image having the interface formed therein rubs against another printed sheet, a toner component peels off from the image starting from the interface to cause a smear.

By contrast, the toner mother particles included in the toner according to the present disclosure contain a block polymer in addition to the polyester resin and the vinyl resin. The block polymer, which has a polyester portion and a vinyl polymer portion, can improve compatibility between the polyester resin and the vinyl resin. Therefore, use of the toner according to the present disclosure can prevent occurrence of a smear.

The following describes the toner further in detail. Note that one of components listed in the following descriptions may be used singly or two or more of the components may be used in combination unless otherwise stated.

[Toner Particles]

FIGURE illustrates an example of a toner particle 1 included in the toner. The toner particle 1 illustrated in FIGURE includes a toner mother particle 2 and an external additive attached to a surface of the toner mother particle 2. The external additive includes external additive particles 3.

However, the toner particles included in the toner according to the present disclosure may have a structure different from the toner particle 1 illustrated in FIGURE. Specifically, the toner particles may include no external additive. The toner particles included in the toner according to the present disclosure have been described in detail with reference to FIGURE.

<Toner Mother Particles>

The toner mother particles contain a binder resin and a magnetic powder. The toner mother particles may further contain an internal additive (for example, at least one of a colorant, a releasing agent, and a charge control agent) as necessary. Examples of a toner mother particle production method include a pulverization method and an aggregation method, and the pulverization method is preferable.

In terms of favorable image formation, the toner mother particles preferably have a volume median diameter ($D_{50}$) of at least 4 μm and no greater than 9 μm.

[Binder Resin]

The toner mother particles contain for example a binder resin as a main component. The binder resin includes a polyester resin, a vinyl resin, and a block polymer.

The binder resin has an acid value of preferably at least 10.0 mgKOH/g and no greater than 30.0 mgKOH/g, and more preferably at least 10.0 mgKOH/g and no greater than 20.0 mgKOH/g. Here, the magnetic powder having an octahedral structure has been subjected to alkaline treatment at production, and therefore, surfaces thereof tend to be alkaline. Therefore, when the binder resin has a comparatively high acid value of at least 10.0 mgKOH/g and no greater than 30.0 mgKOH/g, the surfaces of the magnetic powder is neutralized. As a result, affinity of the surfaces of the magnetic powder for the polyester resin or the polyester portion in the block polymer is further reduced while affinity for the vinyl polymer portion in the block polymer is increased. Thus, the aforementioned three-dimensional mesh structure is readily formed to improve hot offset resistance of the toner of the present disclosure.

The acid value of the binder resin can be adjusted by adjusting the content ratio and the acid value of the polyester resin included in the binder resin. The acid value of the polyester resin can be adjusted by changing the type or the amount of carboxylic acid used for synthesis of the polyester resin. Specifically, use of a carboxylic acid having a large number of carboxy groups in one molecule (tri- or higher-basic carboxylic acids, for example) can increase the acid value of the synthesized polyester resin. Alternatively, the acid value of the polyester resin can be increased by increasing the amount of carboxylic acid relative to the amount of alcohol.

The binder resin has a hydroxyl value of preferably at least 15.0 mgKOH/g and no greater than 30.0 mgKOH/g, and more preferably at least 20.0 mgKOH/g and no greater than 25.0 mgKOH/g.

A percentage of total mass of the vinyl resin and the vinyl polymer portion in the block polymer relative to mass of the binder resin (100×(mass of vinyl resin+mass of vinyl polymer portion)/mass of binder resin) is preferably at least 0.5% by mass and no greater than 25.0% by mass, and more preferably at least 5.0% by mass and no greater than 15.0% by mass. As a result of the above percentage being set to at least 0.5% by mass, hot offset resistance of the toner of the present disclosure can be further improved. As a result of the above percentage being set to no greater than 25.0% by mass, low-temperature fixability of the toner of the present disclosure can be further improved.

A percentage of the linker in the block polymer relative to the binder resin is preferably at least 0.1% by mass and no greater than 5.0% by mass, and more preferably at least 0.5% by mass and no greater than 2.0% by mass.

A percentage of total mass of the polyester resin and the polyester portion in the block polymer relative to the binder resin (100×(mass of polyester resin+mass of polyester portion)/mass of binder resin) is preferably at least 75.0% by mass and no greater than 99.5% by mass, and more preferably at least 85.0% by mass and no greater than 95.0% by mass. As a result of the above percentage being set to at least 75.0% by mass, low-temperature fixability of the toner of the present disclosure can be further improved. As a result of the above percentage being set to no greater than 99.5% by mass, hot offset resistance of the toner of the present disclosure can be further improved.

The binder resin has a glass transition point (Tg) of preferably 40.0° C. or higher and 90.0° C. or lower, and more preferably 50.0° C. or higher and 65.0° C. or lower. The binder resin has a softening point (Tm) of preferably 80.0° C. or higher and 130.0° C. or lower, and more preferably 100.0° C. or higher and 110.0° C. or lower.

The binder resin has a number average molecular weight (Mn) of preferably at least 1,000 and no greater than 3,000, and more preferably at least 1,200 and no greater than 1,500. The binder resin has a mass average molecular weight (Mw) of preferably at least 5,000 and no greater than 50,000, and more preferably at least 10,000 and no greater than 18,000. A ratio (Mw/Mn) of the mass average molecular weight (Mw) to the number average molecular weight (Mn) of the binder resin is preferably at least 5.0 and no greater than 20.0, and more preferably at least 9.0 and no greater than 12.0.

(Polyester Resin)

The polyester resin can be obtained by condensation polymerization of at least one polyhydric alcohol and at least one polybasic carboxylic acid. Examples of an alcohol that can be used for synthesis of the polyester resin include dihydric alcohols (specific examples include diols and bisphenols) and tri- or higher-hydric alcohols listed below. Examples of a carboxylic acid that can be used for synthesis of the polyester resin include dibasic carboxylic acids and tri- or higher-basic carboxylic acids listed below. Note that a polybasic carboxylic acid derivative that can form an ester bond through condensation polymerization (for example, an anhydride of a polybasic carboxylic acid and a polybasic carboxylic acid halide) may be used instead of the polybasic carboxylic acid.

Preferable examples of the diols include ethylene glycol, diethylene glycol, triethylene glycol, 1,2-propanediol, 1,3-propanediol, 1,4-butanediol, neopentyl glycol, 2-butene-1,4-diol, 1,5-pentanediol, 2-pentene-1,5-diol, 1,6-hexanediol, 1,4-cyclohexanedimethanol, dipropylene glycol, 1,4-benzenediol, polyethylene glycol, polypropylene glycol, and polytetramethylene glycol.

Preferable examples of the bisphenols include bisphenol A, hydrogenated bisphenol A, bisphenol A ethylene oxide adduct, and bisphenol A propylene oxide adduct.

Preferable examples of the tri- or higher-hydric alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanethiol, 2-methyl-1,2,4-butanetriol, trimethylolethane, trimethylolpropane, and 1,3,5-trihydroxymethylbenzene.

Preferable examples of the dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, dodecane diacid, azelaic acid, malonic acid, succinic acid, alkyl succinic acids (specific examples include n-butyl succinic acid, isobutyl succinic acid, n-octyl succinic acid, n-dodecyl succinic acid, and isododecyl succinic acid), and alkenyl succinic acids (specific examples include n-butenyl succinic acid, isobutenyl succinic acid, n-octenyl succinic acid, n-dodecenyl succinic acid, and isododecenyl succinic acid).

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, 1,2,4-cyclohexanetricarboxylic acid, tetra(methylenecarboxy)methane, 1,2,7,8-octanetetracarboxylic acid, pyromellitic acid, and empol trimer acid.

The polyester resin is preferably a condensation polymer of terephthalic acid, isophthalic acid, a bisphenol A ethylene oxide adduct, and ethylene glycol or a condensation polymer of sebacic acid, dodecane diacid, 1,4-butanediol, and 1,6-hexanediol.

[Vinyl Resin]

A vinyl resin is a polymer of a monomer containing a vinyl compound. The vinyl compound is a compound having a vinyl group ($CH_2$=CH—) or a group in which hydrogen in the vinyl group is replaced (however, compounds corresponding to bireactive monomers are excluded). The vinyl compound undergoes addition polymerization due to the presence of a carbon-carbon double bond (C=C) contained in a vinyl group or a group in which hydrogen in the vinyl group is replaced, to form a vinyl resin.

Examples of the vinyl compound include styrene-based compounds, (meth)acrylic acid alkyl esters, and (meth) acrylic acid phenyl esters. Examples of the vinyl compound further include (meth)acrylonitrile and vinyl chloride.

Examples of the styrene-based compounds include styrene, o-methylstyrene, m-methylstyrene, p-methylstyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecyl styrene.

Examples of the (meth)acrylic acid alkyl esters include methyl (meth)acrylate, ethyl (meth)acrylate, n-propyl (meth)acrylate, isopropyl (meth)acrylate, n-butyl (meth) acrylate, isobutyl (meth)acrylate, t-butyl (meth)acrylate, n-octyl (meth)acrylate, 2-ethylhexyl (meth)acrylate, stearyl (meth)acrylate, and lauryl (meth)acrylate.

Examples of the (meth)acrylic acid phenyl esters include phenyl (meth)acrylate.

The vinyl compound is preferably a styrene compound, a (meth)acrylic acid alkyl ester, or (meth)acrylonitrile, and more preferably styrene, methyl methacrylate, or acrylonitrile.

[Block Polymer]

The block polymer includes a polyester portion, a vinyl polymer portion, and a linker that links the polyester portion and the vinyl polymer portion. The linker is derived from a bireactive monomer having a vinyl group and at least one of a carboxy group and an alcoholic hydroxyl group.

The vinyl polymer portion in the block polymer has a repeating unit derived from a vinyl compound. Examples of the vinyl compound include the same compounds as the vinyl compounds listed above in the Vinyl Resin. The vinyl polymer portion in the block polymer and the vinyl resin preferably have the same repeating unit.

The polyester portion in the block polymer has a repeating unit formed by condensation polymerization of at least one polyhydric alcohol and at least one polybasic carboxylic acid. Examples of the polyhydric alcohol and the polybasic carboxylic acid forming the polyester portion in the block polymer include the same compounds as the polyhydric alcohols and the polycarboxylic acids listed for the polyester resin described above. The polyester portion in the block polymer and the polyester resin preferably have the same repeating unit.

In terms of facilitating synthesis of the block polymer, the bireactive monomer for formation of a linker is preferably a compound having a single vinyl group and a single carboxy group, or a compound having a single vinyl group and a single hydroxyl group.

Examples of the bireactive monomer include (meth) acrylic acid, a (meth)acrylic acid hydroxyalkyl ester, fumaric acid, and maleic acid, among which acrylic acid, methacrylic acid, or 2-hydroxymethyl methacrylate is preferred.

The fact that the binder resin includes the block polymer can be confirmed by GC-MS analysis, for example. Specifically, it can be confirmed that the block polymer is included in the binding resin when a fragment ion having a linker derived from the bireactive monomer, a fragment of the vinyl polymer portion, and a fragment of the polyester portion are detected through GC-MS analysis of the toner of the present disclosure.

The binder resin preferably includes only a polyester resin, a vinyl resin, and a block polymer, but may further include an additional binder resin other than the polyester resin, the vinyl resin, and the block polymer. Examples of the additional binder resin include olefin resins (specific examples include polyethylene resin or polypropylene resin), polyamide resins, and urethane resins. The total content ratio of the polyester resin, the vinyl resin, and the block polymer in the binder resin is preferably at least 90% by mass, and more preferably 100% by mass.

The content ratio of the binder resin in the toner mother particles is preferably at least 30% by mass and no greater than 90% by mass, and more preferably at least 40% by mass and no greater than 70% by mass.

(Binder Resin Synthesis Method)

The binder resin including a polyester resin, a vinyl resin, and a block polymer can be obtained by a synthesis method including a reaction process of an addition polymerization of a polyester resin, a bireactive monomer, and a vinyl compound, for example. In the synthesis method, first, a carboxy group or a hydroxyl group at a terminal of the polyester resin and a carboxy group or a hydroxyl group in the bireactive monomer undergo a condensation reaction. As a result, a repeating unit derived from the bireactive monomer is introduced into the terminal of the polyester resin. Next, the bireactive monomer introduced into the terminal of the polyester resin and the vinyl compound undergo an addition polymerization reaction. Through the above, a block polymer having a polyester portion derived from the polyester resin, a linker derived from the bireactive monomer, and a vinyl polymer portion derived from the vinyl compound is obtained. Specifically, a block polymer having a polyester portion derived from the polyester resin, a linker linked to a terminal of the polyester portion, and a vinyl polymer portion linked to the linker is obtained.

In the reaction process, part of the polyester resin remains in the reaction system without reacting with the bireactive monomer. In addition, part of the vinyl compound does not react with the polyester resin having a repeating unit derived from the bireactive monomer introduced to the terminal thereof, but reacts with another portion of the vinyl compound or the bireactive monomer to form a vinyl resin. Through the above-described reactions in the binder resin synthesis method, a binder resin including the polyester resin, the vinyl resin, and the block polymer can be obtained.

In the reaction process, a polybasic carboxylic acid may be further added in addition to the polyester resin, the bireactive monomer, and the vinyl compound. By further adding a polybasic carboxylic acid, the acid value of the polyester resin can be increased, and as a result, the acid value of the binder resin to be synthesized can be increased. The amount of the polybasic carboxylic acid to be added is, for example, at least 0.1 parts by mass and no greater than 1.0 part by mass relative to 100 parts by mass of the polyester resin. The polyester resin, the bireactive monomer, and the vinyl compound, as well as and the polybasic carboxylic acid added as necessary may be referred to below as "reaction materials".

The total percentage of the polyester resin and the polybasic carboxylic acid relative to the total amount of the reaction materials is preferably at least 75.0% by mass and no greater than 99.5% by mass, and more preferably at least 85.0% by mass and no greater than 95.0% by mass.

The percentage of the bireactive monomer relative to the total amount of the reaction materials is preferably at least 0.1% by mass and no greater than 5.0% by mass, and more preferably at least 0.5% by mass and no greater than 2.0% by mass.

The percentage of the vinyl compound relative to the total amount of the reaction materials is preferably at least 0.5% by mass and no greater than 25.0% by mass, and more preferably at least 5.0% by mass and no greater than 15.0% by mass.

In the reaction process, a known radical polymerization initiator (for example, dicumyl peroxide) is preferably added. The amount of the radical polymerization initiator to be added is, for example, at least 0.2 parts by mass and no greater than 1.5 parts by mass relative to 100 parts by mass of the total amount of the reaction materials.

The binder resin can also be obtained by, for example, a method in which a polyester resin, a vinyl resin, and a block polymer are separately synthesized and then mixed together.

(Magnetic Powder)

The magnetic powder in the toner mother particles has an octahedral structure. The magnetic powder having an octahedral structure can be obtained by an alkaline treatment performed in production of the magnetic powder. Whether or not the magnetic powder has an octahedral structure can be determined by observing the magnetic powder with an electron microscope.

Examples of materials of the magnetic powder that can be favorably used include ferromagnetic metals (specific examples include iron, cobalt, nickel, and alloys including at least one of these metals), ferromagnetic metal oxides (specific examples include ferrite, magnetite, and chromium dioxide), and materials subjected to ferromagnetization (specific examples include carbon materials to which ferromagnetism is imparted through thermal treatment).

In terms of favorable image formation, the amount of the magnetic powder contained in the toner mother particles is preferably at least 40 parts by mass and no greater than 120 parts by mass relative to 100 parts by mass of the binder resin and more preferably at least 60 parts by mass and no greater than 90 parts by mass.

The magnetic powder preferably has a number average primary particle diameter of at least 0.1 μm and no greater than 1.0 μm, and more preferably at least 0.1 μm and no greater than 0.3 μm.

The BET specific surface area of the magnetic powder is preferably at least 7.1 $m^2/g$. The BET specific surface area of the magnetic powder is for example no greater than 7.5 $m^2/g$. As a result of the magnetic powder having a BET specific surface area of at least 7.1 $m^2/g$, the vinyl polymer portion in the block polymer and the magnetic powder tend to adsorb to each other. Consequently, hot offset resistance of the toner according to the present disclosure is further improved.

The magnetic powder is preferably subjected to surface treatment in order to inhibit elution of metal ions (for example, iron ions) from the magnetic powder. Elution of metal ions to surfaces of the toner mother particles tends to lead adhesion of toner mother particles to one another. It is thought that inhibition of metal ion elution from the magnetic powder can inhibit adhesion of toner mother particles to one another.

(Colorant)

The toner mother particles may contain a colorant. The colorant can be a known pigment or dye that matches the color of the toner. The amount of the colorant is preferably at least 1 part by mass and no greater than 20 parts by mass relative to 100 parts by mass of the binder resin in terms of high-quality image formation using the toner.

The toner mother particles may contain a black colorant. Carbon black can for example be used as a black colorant. Alternatively, a colorant can be used that has been adjusted to a black color using a yellow colorant, a magenta colorant, and a cyan colorant. A magnetic powder may be used as the black colorant. That is, the toner mother particles need not contain a colorant other than the magnetic powder.

(Releasing Agent)

The toner mother particles may contain a releasing agent. The releasing agent is for example used in order to further improve hot offset resistance of the toner. The amount of the releasing agent is preferably at least 1 part by mass and no greater than 20 parts by mass relative to 100 parts by mass of the binder resin in terms of impartment of sufficient hot offset resistance to the toner.

Examples of the releasing agent include aliphatic hydrocarbon-based waxes, oxides of aliphatic hydrocarbon-based waxes, plant waxes, animal waxes, mineral waxes, ester waxes containing a fatty acid ester as a main component, and waxes in which part or all of a fatty acid ester has been deoxidized (for example, deoxidized carnauba wax). Examples of the aliphatic hydrocarbon-based waxes include low molecular weight polyethylene, low molecular weight polypropylene, polyolefin copolymers, polyolefin wax, microcrystalline wax, paraffin wax, and Fischer-Tropsch wax. Examples of the oxides of aliphatic hydrocarbon-based waxes include polyethylene oxide waxes and block copolymers of polyethylene oxide waxes. Examples of the plant waxes include candelilla wax, carnauba wax, Japan wax, jojoba wax, and rice wax. Examples of the animal waxes include beeswax, lanolin, and spermaceti. Examples of the mineral waxes include ozokerite, ceresin, and petrolatum. Examples of the ester waxes containing a fatty acid ester as a main component include montanic acid ester wax and castor wax. Preferably, the releasing agent is an ester wax.

When the toner mother particles contain a releasing agent, a compatibilizer may be further added to the toner mother particles in order to improve compatibility between the binder resin (particularly, the polyester resin) and the releasing agent.

(Charge Control Agent)

The toner mother particles may contain a charge control agent. The charge control agent is used for example in order to provide a toner excellent in charge stability or a charge rise characteristic. The charge rise characteristic of a toner is an indicator as to whether or not the toner can be charged to a specific charge level in a short period of time.

Examples of the positively chargeable charge control agent include azine compounds, direct dyes, nigrosine dyes, metal salts of naphthenic acids, metal salts of higher organic carboxylic acids, alkoxylated amine, alkylamide, quaternary ammonium salts, and resins having a quaternary ammonium cation group. Examples of the azine compounds include pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1-2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline. Examples of the direct dyes include Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL. Examples of the nigrosine dyes include nigrosine BK, nigrosine BN, and nigrosine Z. Examples of the quaternary ammonium salts include benzyldecylhexylmethyl ammonium chloride, decyltrimethyl ammonium chloride, 2-(methacryloyloxy)ethyl trimethylammonium chloride, and dimethylaminopropyl acrylamide methyl chloride quaternary salt. In terms of providing a positively chargeable toner excellent in charge stability, the charge control agent is preferably a resin having a quaternary ammonium cation group.

The amount of the charge control agent is preferably at least 0.1 parts by mass and no greater than 10 parts by mass relative to 100 parts by mass of the binder resin in terms of improving charge stability.

(External Additive Particles)

The external additive particles are preferably inorganic particles, more preferably silica particles or particles of a metal oxide (specific examples include alumina, titanium oxide, magnesium oxide, and zinc oxide), and further preferably silica particles or titanium oxide particles, and particularly preferably hydrophobic silica particles or conductive titanium oxide particles. However, resin particles or particles of an organic oxide compound such as a fatty acid metal salt (specific examples include zinc stearate) may be used as the external additive particles.

In terms of inhibiting separation of the external additive particles from the toner mother particles and sufficiently exhibiting functions of the external additive particles, the amount of the external additive particles in the toner particles is preferably at least 0.1 parts by mass and no greater than 15.0 parts by mass relative to 100 parts by mass of the toner mother particles and more preferably at least 0.5 parts by mass and no greater than 5.0 parts by mass.

[Toner Production Method]

The following describes an example of a production method of the toner according to the present disclosure. The production method of the toner includes a toner mother particle preparation process for preparing the toner mother particles. The production method of the toner may further include another process (for example, a later-described external addition process) after the toner mother particle preparation process.

(Toner Mother Particle Preparing Process)

In the toner mother particle preparation process, the toner mother particles are prepared for example by a pulverization method or an aggregation method.

In an example of the pulverization method, the binder resin, the magnetic powder, and another internal additive optionally added depending on necessity thereof are mixed together first. Subsequently, the resultant mixture is melt-kneaded using a melt-kneader (for example, a single or twin screw extruder). Next, the resultant melt-kneaded product is pulverized and classified. Through the above, the toner mother particles are obtained.

In an example of the aggregation method, respective types of fine particles of the binder resin and the magnetic powder, and another internal additive optionally added depending on necessity thereof are caused to aggregate in an aqueous medium including the fine particles of these types until the fine particles have a desired particle diameter. Through aggregation as above, aggregated particles containing at least the binder resin and the magnetic powder are formed. Subsequently, the aggregated particles are heated to cause components contained in the aggregated particles to coalesce. Through the above, the toner mother particles are obtained.

(External Addition Process)

In the present process, an external additive is attached to surfaces of the toner mother particles. Examples of a method for attaching the external additive to the surfaces of the toner mother particles include a method in which the external additive is attached to the surfaces of the toner mother particles by stirring and mixing the toner mother particles and external additive particles using for example a mixer.

EXAMPLES

The following provides more specific description of the present disclosure through use of Examples. However, it should be noted that the present disclosure is not limited to the scope of Examples.

Binder resins (B-1) to (B-10) and (b-1) to (b-2) were synthesized by the following methods.

[Synthesis of Binder Resin (B-1)]

(Synthesis of Polyester Resin)

Into a 5-L four-necked flask equipped with a thermometer (thermocouple), a drying tube, a nitrogen introduction tube, and a stirrer, 1,245 g of terephthalic acid, 1,245 g of isophthalic acid, 1,248 g of bisphenol A ethylene oxide adduct, and 744 g of ethylene glycol were added. Next, after a nitrogen atmosphere was established inside the flask, the internal temperature of the flask was raised to 250° C. while the flask contents were stirred. Thereafter, the flask contents were reacted at normal pressure and 250° C. for 4 hours. Thereafter, 0.875 g of antimony trioxide, 0.548 g of triphenyl phosphate, and 0.102 g of tetrabutyl titanate were added as catalysts into the flask. Next, the internal pressure of the flask was reduced to 40 Pa, and then the internal temperature of the flask was raised to 280° C. Next, while kept at 280° C., the flask contents were reacted for a reaction time A (6 hours) as shown in Table 2 below, so that a polyester resin was synthesized.

(Synthesis of Binder Resin)

Into the flask as a reaction vessel where the polyester resin had been synthesized, 30 g of trimellitic acid as a polybasic carboxylic acid, 50 g of acrylic acid as a bireactive monomer, 500 g of styrene as a vinyl compound, and 30 g of dicumyl peroxide as a radical polymerization initiator were added. Thereafter, the internal pressure of the flask was returned to normal pressure, and then internal temperature of the flask was reduced to 160° C. Thereafter, the flask contents were reacted at normal pressure and 160° C. for 1 hour. After completion of the reaction, the flask contents were taken out and cooled. Through the above, a binder resin (B-1) was obtained.

[Synthesis of Binder Resins (B-2) to (B-10) and (b-1) to (b-2)]

The binder resins (B-2) to (B-10) and (b-1) to (b-2) were synthesized by the same method as that for the binder resin (B-1) in all aspects other than that changes were made as follows. In the synthesis of the binder resins (B-2) to (B-10) and (b-1) to (b-2), the types and amounts of the polyester materials (specifically, the polybasic carboxylic acid and the polyhydric alcohol added in the synthesis of the polyester resin or the synthesis of the binder resin), the types and amounts of the catalyst, the type and amount of the vinyl compound, the type and amount of the bireactive monomer, and the amount of the radical polymerization initiator were changed as shown in Table 1 below. Furthermore, in the synthesis of the binder resins (B-2) to (B-10) and (b-1) to (b-2), the reaction time A in synthesis of the polyester resin was changed as shown in Table 2 below.

Note that each of acrylic acid and methacrylic acid is a bireactive monomer having a vinyl group and a carboxy group. 2-Hydroxymethyl methacrylate is a bireactive monomer having a vinyl group and an alcoholic hydroxyl group.

With respect to each of the synthesized binder resins (B-1) to (B-10) and (b-1) to (b-2), glass transition point (Tg), softening point (Tm), number average molecular weight (Mn), mass average molecular weight (Mw), acid value, and hydroxyl value were determined. In addition, molecular weight distribution (Mw/Mn) was calculated based on the determined number average molecular weight (Mn) and the determined mass average molecular weight (Mw). Table 2 below shows the measurement results and the calculation results.

In Table 1 below, "EO-modified bisphenol A" refers to a bisphenol A ethylene oxide adduct. "First amount" of "Polyester material" indicates respective amounts of polybasic carboxylic acids and polyhydric alcohols added in the synthesis of the polyester resins. "Second amount" of "Polyester material" indicates amounts of the polybasic carboxylic acid added in the synthesis of the binder resins. "Initiator" refers to a radical polymerization initiator. "% by mass" of each of "Polyester material", "Bireactive monomer", and "Vinyl compound" indicates the percentage of the amount of a corresponding one of the components relative to the total amount of the polyester material, the bireactive monomer, and the vinyl compound. "-" indicates that a corresponding component was not added.

TABLE 1

| Binder resin | | | B-1 | B-2 | B-3 | B-4 | B-5 | B-6 | B-7 | B-8 | B-9 | B-10 | b-1 | b-2 |
|---|---|---|---|---|---|---|---|---|---|---|---|---|---|---|
| Polyester material | First amount [g] | Terephthalic acid | 1245 | 1100 | 1300 | 1300 | 1300 | — | 1245 | 1245 | 1245 | 1245 | 1245 | 1245 |
| | | Isophthalic acid | 1245 | 1100 | 1300 | 1300 | 1300 | — | 1245 | 1245 | 1245 | 1245 | 1245 | 1245 |
| | | EO-modified bisphenol A | 1248 | 1100 | 1300 | 1300 | 1300 | — | 1248 | 1248 | 1248 | 1248 | 1248 | 1248 |
| | | Ethylene glycol | 744 | 670 | 780 | 780 | 780 | — | 744 | 744 | 744 | 744 | 744 | 744 |
| | | Sebacic acid | — | — | — | — | — | 1245 | — | — | — | — | — | — |
| | | Dodecane diacid | — | — | — | — | — | 1245 | — | — | — | — | — | — |
| | | 1,4-Butanediol | — | — | — | — | — | 1248 | — | — | — | — | — | — |
| | | 1,6-Hexanediol | — | — | — | — | — | 744 | — | — | — | — | — | — |
| | Second amount [g] | Trimellitic acid | 30 | 30 | 30 | 11 | 45 | 30 | 30 | 35 | 30 | 30 | 30 | 30 |
| Total [g] | | | 4512 | 4000 | 4710 | 4691 | 4725 | 4512 | 4512 | 4517 | 4512 | 4512 | 4512 | 4512 |
| % by mass | | | 89.1 | 79.2 | 97.9 | 89.5 | 89.6 | 89.1 | 89.1 | 89.1 | 89.1 | 89.1 | 98.9 | 90.0 |
| Catalyst | Amount [g] | Antimony trioxide | 0.875 | 0.875 | 0.875 | 0.875 | 0.875 | — | 0.875 | 0.875 | 0.875 | 0.875 | 0.875 | 0.875 |
| | | Triphenyl phosphate | 0.548 | 0.548 | 0.548 | 0.548 | 0.548 | — | 0.548 | 0.548 | 0.548 | 0.548 | 0.548 | 0.548 |
| | | Tetraphenyl phosphate | 0.102 | 0.102 | 0.102 | 0.102 | 0.102 | — | 0.102 | 0.102 | 0.102 | 0.102 | 0.102 | 0.102 |
| | | Tetramethyl titanate | — | — | — | — | — | 0.875 | — | — | — | — | — | — |
| | | Diisooctyl phosphate | — | — | — | — | — | 0.548 | — | — | — | — | — | — |
| | | Phenyl phosphate | — | — | — | — | — | 0.102 | — | — | — | — | — | — |
| Bireactive monomer | Amount [g] | Acrylic acid | 50 | 50 | 50 | 50 | 50 | 50 | — | — | 50 | 50 | 50 | — |
| | | Methacrylic acid | — | — | — | — | — | — | 50 | — | — | — | — | — |
| | | 2-Hydroxymethyl methacrylate | — | — | — | — | — | — | — | 50 | — | — | — | — |
| % by mass | | | 1.0 | 1.0 | 1.0 | 1.0 | 0.9 | 1.0 | 1.0 | 1.0 | 1.0 | 1.0 | 1.1 | 0.0 |
| Vinyl compound | Amount [g] | Styrene | 500 | 1000 | 50 | 500 | 500 | 500 | 500 | 500 | — | — | — | 500 |
| | | Methyl methacrylate | — | — | — | — | — | — | — | — | 500 | — | — | — |
| | | Acrylonitrile | — | — | — | — | — | — | — | — | — | 500 | — | — |
| % by mass | | | 9.9 | 19.8 | 1.0 | 9.5 | 9.5 | 9.9 | 9.9 | 9.9 | 9.9 | 9.9 | 0.0 | 10.0 |
| Initiator | Amount [g] | Dicumyl peroxide | 30 | 30 | 30 | 30 | 30 | 30 | 30 | 30 | 30 | 30 | — | 30 |

TABLE 2

| Binder resin | | B-1 | B-2 | B-3 | B-4 | B-5 | B-6 | B-7 | B-8 | B-9 | B-10 | b-1 | b-2 |
|---|---|---|---|---|---|---|---|---|---|---|---|---|---|
| Synthesis condition | Reaction temperature A [h] | 6 | 6 | 6 | 8 | 4 | 6 | 6 | 6 | 6 | 6 | 6 | 6 |
| Properties | Tg [° C.] | 58.8 | 60.2 | 58.2 | 57.2 | 59.3 | 57.6 | 59.0 | 57.3 | 57.2 | 58.9 | 58.6 | 57.8 |
| | Tm [° C.] | 101.2 | 100.2 | 100.2 | 101.3 | 102.3 | 106.2 | 102.3 | 101.9 | 103.2 | 105.2 | 102.5 | 100.3 |
| | Mn | 1376 | 1365 | 1320 | 1390 | 1430 | 1250 | 1297 | 1297 | 1366 | 1372 | 1310 | 1290 |
| | Mw | 13900 | 14100 | 14050 | 13860 | 14200 | 13510 | 14500 | 13280 | 14110 | 13670 | 13600 | 13720 |
| | Mw/Mn | 10.1 | 10.3 | 10.6 | 10.0 | 9.9 | 10.8 | 11.2 | 10.2 | 10.3 | 10.0 | 10.4 | 10.6 |
| | Acid value [mgKOH/g] | 16.3 | 15.3 | 16.5 | 10.5 | 19.2 | 15.2 | 15.8 | 11.2 | 18.2 | 16.2 | 8.3 | 8.1 |
| | Hydroxyl value [mgKOH/g] | 24.2 | 24.5 | 23.5 | 24.3 | 22.7 | 18.6 | 23.7 | 24.9 | 23.2 | 24.2 | 23.1 | 22.4 |

<Preparation of Toner>

Toners of Examples and Comparative Examples were prepared by the following methods. First, magnetic powders used for toner preparation will be described.

(Magnetic Powder)

Magnetic powder A: "MRO-15A", product of Toda Kogyo Corp., shape: octahedral, component: magnetite, saturation magnetization σs: 85.5 $Am^2/kg$, coercive force Hc: 120 Oe, BET specific surface area: 7.3 $m^2/g$, number average primary particle diameter: 180 nm Magnetic powder B: "MTS-106", product of Toda Kogyo Corp., shape: spherical, component: magnetite, saturation magnetization σs: 84.3 $Am^2/kg$, coercive force Hc: 570 Oe, BET specific surface area: 7.0 $m^2/g$, number average primary particle diameter: 230 nm

[Preparation of Toner (T-1)]

(Preparation of Toner Mother Particles)

An FM mixer ("FM-20B", product of Nippon Coke & Engineering Co., Ltd.) was charged with 100 parts by mass of the binder resin(B-1), 90 parts by mass of the magnetic powder A, 10 parts by mass of a charge control agent ("ACRYBASE" (registered Japanese trademark) FCA-201PS", product of FUJIKURA KASEI CO., LTD., component: styrene-acrylic acid-based resin including a repeating unit derived from quaternary ammonium salt), and 4 parts by mass of a carnauba wax (product of TOA KASEI CO., LTD.) as a releasing agent. The contents of the FM mixer were mixed by operating the FM mixer under conditions of a rotational speed of 200 rpm and a stirring time of 4 minutes to give a mixture.

The resultant mixture was melt-kneaded using a twin screw extruder ("TEM-26SS", product of Toshiba Machine Co., Ltd.) under conditions of a cylinder temperature of 100° C., a shaft rotational speed of 100 rpm, and a material feeding speed of 50 g/min. The resulting melt-kneaded product was subsequently cooled. Thereafter, the cooled melt-kneaded product was introduced into an impact jet mill ("MICRON JET (registered Japanese trademark) MJT-1", product of Hosokawa Micron Corporation) to pulverize and classify the melt-kneaded product. Through the above, toner mother particles having a volume median diameter of 8 μm were obtained.

(External Addition)

An FM mixer ("FM-20B", product of Nippon Coke & Engineering Co., Ltd.) was charged with 100 parts by mass of the obtained toner mother particles, and 0.6 parts by mass of hydrophobic silica particles ("AEROSIL (registered Japanese trademark) RA-200", product of Nippon Aerosil Co., Ltd.) and conductive titanium oxide particles ("EC-100", product of Titan Kogyo, Ltd.) as external additives. The contents of the FM mixer were mixed by operating the FM mixer under conditions of a rotational speed of 2,400 rpm and a stirring time of 5 minutes. Through the above, a toner (T-1) was obtained.

[Preparation of Toners (T-2) to (T-10) and (t-1) to (t-3)]

Toners (T-2) to (T-10) and (t-1) to (t-3) were prepared by the same method as that for the toner (T-1) in all aspects other than that changes were made as follows. In the preparation of the toners (T-2) to (T-10) and (t-1) to (t-3), the type of the binder resin and the type of the magnetic powder were changed as shown in Table 3 below.

<Evaluation>

Low-temperature fixability, hot offset resistance, and smear resistance of each toner were evaluated by the methods described below. The evaluation results are shown in Table 3 below.

[Evaluation Apparatus]

A monochrome page printer ("ECOSYS (registered Japanese trademark) LS-4200DN", product of KYOCERA Document Solutions Inc.) was modified so that the fixing temperature of a fixing device of the monochrome page printer is able to change. The resultant modified apparatus was used as an evaluation apparatus. A toner (specifically, one of the toners (T-1) to (T-10) and (t-1) to (t-3)) was loaded in a development device of the evaluation apparatus. A toner for replenishment use (specifically, the same toner as the toner loaded in the development device) was loaded in a toner container of the evaluation apparatus.

[Low-Temperature Fixability]

Using the above-described evaluation apparatus, a 25 mm×25 mm solid image (coverage rate: 100%) was formed on A4-size printing paper (evaluation paper, basis rate: 90 $g/m^2$) under conditions of a toner application amount of 1.0 $mg/cm^2$ and a linear velocity of 336 mm/min.

In evaluation of minimum fixable temperature, the fixing temperature was set in a range of from 160° C. to 220° C. Specifically, the fixing temperature of the fixing device included in the evaluation apparatus was increased from 160° C. in increments of 5° C. to determine a minimum temperature at which an unfixed solid image (toner image) could be fixed to paper (minimum fixable temperature). Whether or not the toner could be fixed was confirmed by the fold-rubbing test described below.

(Fold-Rubbing Test)

Image density of the solid image printed on evaluation paper (initial image density $D_1$) was measured using a Macbeth reflection densitometer ("RD914", product of X-Rite). The evaluation paper after the measurement was folded in half such that a surface with the solid image formed thereon might come inward and that the fold might pass through the center of the solid image. Thereafter, the fold in the evaluation paper was rubbed back and forth ten times with a load of 1 kg applied by a brass weight covered with cotton cloth. Next, the paper was opened up and the image density of the solid image (image density $D_2$ after the fold rubbing test) was measured using the Macbeth reflection densitometer described above. The fixing rate [%] of the solid image (after to before the fold-rubbing test) was calculated based on the following formula. When the fixing rate of the solid image was at least 95%, it was determined that the toner was successfully fixed.

$$\text{Solid image fixing rate} = 100 \times D_2/D_1$$

Low-temperature fixability of the toner was evaluated as "good (A)" when the minimum fixable temperature was 200° C. or lower, and as "poor (B)" when the minimum fixable temperature was higher than 200° C. Table 3 below also shows initial image density measured in the fold rubbing test for minimum fixable temperature of each toner.

[Hot Offset Resistance]

In evaluation of hot offset resistance, the output mode of the evaluation apparatus was set to a half-speed mode so that hot offset might easily occur. Using the above-described evaluation apparatus, a 25 mm×25 mm solid image (coverage rate: 100%) was formed on A4-size printing paper (basis rate: 90 $g/m^2$) under conditions of a toner application amount of 1.0 $mg/cm^2$ and a linear velocity of 168 mm/min.

In the evaluation of hot offset resistance, the fixing temperature was set in a range of from 180° C. to 250° C. Specifically, the fixing temperature of the fixing device included in the evaluation apparatus was increased from 180° C. in increments of 5° C. to determine a minimum temperature at which hot offset occurred (hot offset temperature). Whether or not hot offset had occurred was confirmed by visually observing a fixing roller of the fixing device after fixing. When stain due to occurrence of hot offset was confirmed on the fixing roller, it was determined that hot offset had occurred. The hot offset resistance of the toner was evaluated as "good (A)" when the hot offset temperature was higher than 200° C., and as "poor (B)" when the hot offset temperature was 200° C. or lower.

[Smear Resistance]

Using the above-described evaluation apparatus, duplex printing was continuously performed on 500 sheets of A4-size printing paper (basis rate: 90 g/m$^2$) under conditions of a toner application amount of 1.0 mg/cm$^2$, a linear velocity of 336 mm/min, and a coverage rate of 8%. The resultant 500 printed sheets were visually observed to confirm whether or not a smear had been produced. Smear resistance of the toner was evaluated as "good (A)" when no smear had been produced, and as "poor (B)" when a smear had been produced.

In Table 3 below, "HO temperature" refers to a temperature at which hot offset had occurred.

TABLE 3

| | | | | | Low-temperature fixability | | Hot offset resistance | | |
|---|---|---|---|---|---|---|---|---|---|
| | Binder | Magnetic powder | | Initial image | Minimum fixable temperature | | HO temperature | | Smear |
| Toner | resin | Type | Shape | density | [° C.] | Evaluation | [° C.] | Evaluation | resistance |
| T-1 | B-1 | A | Octahedral | 1.21 | 195 | A | 240 | A | A |
| T-2 | B-2 | A | Octahedral | 1.22 | 200 | A | 235 | A | A |
| T-3 | B-3 | A | Octahedral | 1.18 | 195 | A | 235 | A | A |
| T-4 | B-4 | A | Octahedral | 1.22 | 195 | A | 235 | A | A |
| T-5 | B-5 | A | Octahedral | 1.18 | 195 | A | 230 | A | A |
| T-6 | B-6 | A | Octahedral | 1.18 | 200 | A | 230 | A | A |
| T-7 | B-7 | A | Octahedral | 1.21 | 195 | A | 240 | A | A |
| T-8 | B-8 | A | Octahedral | 1.18 | 200 | A | 245 | A | A |
| T-9 | B-9 | A | Octahedral | 1.21 | 195 | A | 240 | A | A |
| T-10 | B-10 | A | Octahedral | 1.20 | 200 | A | 245 | A | A |
| t-1 | B-1 | B | Spherical | 1.21 | 195 | A | 200 | B | A |
| t-2 | b-1 | A | Octahedral | 1.21 | 200 | A | 195 | B | A |
| t-3 | b-2 | A | Octahedral | 1.21 | 195 | A | 195 | B | B |

Toners (T-1) to (T-10) each contained toner particles. The toner particles each included a toner mother particle. The toner mother particles contained a binder resin and a magnetic powder. The binder resin included a polyester resin, a vinyl resin, and a block polymer. The block polymer included a polyester portion, a vinyl polymer portion, and a linker that links the polyester portion and the vinyl polymer portion. The linker was derived from a bireactive monomer having a vinyl group and at least one of a carboxy group and an alcoholic hydroxyl group. The magnetic powder contained magnetic powder having an octahedral structure. Toners (T-1) to (T-10) were excellent in low-temperature fixability and hot offset resistance. The toners (T-1) to (T-10) were also excellent in smear resistance.

By contrast, since each of the toners (t-1) to (t-3) did not have the above-described constitution, at least one of low-temperature fixability, hot offset resistance, and smear resistance was poor.

Specifically, the toner (t-1) contained the spherical magnetic powder B as a magnetic powder. Spherical magnetic powder has a smaller specific surface area than octahedral magnetic powder having the same particle diameter as that of the spherical magnetic powder, and has curved surfaces. Accordingly, adsorption of the magnetic powder to the vinyl polymer portion in the block polymer was insufficient in the toner (t-1), resulting in lack of formation of the tree-dimensional mesh structure described above. As a result, the determination of poor hot offset resistance was made for the toner (t-1).

The toner (t-2) contained the binder resin (b-1) as a binder resin. The binder resin (b-1) contained neither a vinyl resin nor a block polymer because no vinyl compound was used in the synthesis thereof. Accordingly, the tree-dimensional mesh structure described above was not formed in the toner mother particles, and as a result, the determination of poor hot offset resistance was made for the toner (t-2).

The toner (t-3) contained the binder resin (b-2) as a binder resin. The binder resin (b-2) did not contain a block polymer because no bireactive monomer was used in the synthesis thereof. Accordingly, the tree-dimensional mesh structure described above was not formed in the toner mother particles, and as a result, the determination of poor hot offset resistance was made for the toner (t-3). Further, the binder resin of the toner (t-3) included a vinyl resin and a polyester resin, but included no block polymer. Therefore, in the image formed with the toner (t-3), an interface was formed due to phase separation between the polyester resin and the vinyl resin, and the toner components peeled off starting from the interface, resulting in the determination that a smear had been produced.

What is claimed is:

1. A toner comprising toner particles, wherein the toner particles each include a toner mother particle, the toner mother particles contain a binder resin and a magnetic powder, the binder resin includes a polyester resin, a vinyl resin, and a block polymer, the block polymer includes a polyester portion, a vinyl polymer portion, and a linker that links the polyester portion and the vinyl polymer portion, the linker is derived from a specific compound having a vinyl group and at least one of a carboxy group and an alcoholic hydroxyl group, the polyester resin and the polyester portion each include a repeating unit derived from terephthalic acid, a repeating unit derived from isophthalic acid, a repeating unit derived from trimellitic acid, a repeating unit derived from ethylene glycol, and a repeating unit derived from bisphenol A ethylene oxide adduct, and the magnetic powder has an octahedral structure.

2. The toner according to claim 1, wherein a percentage of a total mass of the vinyl resin and the vinyl polymer portion in the block polymer relative to a mass of the binder resin is at least 0.5% by mass and no greater than 25.0% by mass.

3. The toner according to claim 1, wherein the binder resin has an acid value of at least 10.0 mgKOH/g and no greater than 30.0 mgKOH/g.

4. The toner according to claim 1, wherein the specific compound includes at least one of (meth) acrylic acid and a (meth)acrylic acid hydroxyalkyl ester.

* * * * *